US008519925B2

(12) United States Patent
Phan

(10) Patent No.: US 8,519,925 B2
(45) Date of Patent: Aug. 27, 2013

(54) MULTI-RESOLUTION DISPLAY SYSTEM

(75) Inventor: Gia Chuong Phan, Hong Kong (CN)

(73) Assignee: VP Assets Limited, Hong Kong Science Park, Shatin, N.T. (HK)

( * ) Notice: Subject to any disclaimer, the term of this patent is extended or adjusted under 35 U.S.C. 154(b) by 1271 days.

(21) Appl. No.: 11/606,127

(22) Filed: Nov. 30, 2006

(65) Prior Publication Data

US 2008/0129760 A1 Jun. 5, 2008

(51) Int. Cl.
*G09G 3/36* (2006.01)

(52) U.S. Cl.
USPC ..... 345/87; 345/88; 345/89; 345/204; 345/690

(58) Field of Classification Search
USPC ..... 345/50–52, 102, 690–698, 87–90
See application file for complete search history.

(56) References Cited

U.S. PATENT DOCUMENTS

| | | | | |
|---|---|---|---|---|
| 6,268,839 | B1 | 7/2001 | Yang et al. | |
| 6,549,682 | B2 * | 4/2003 | Okada | 382/298 |
| 7,002,537 | B1 | 2/2006 | Ito | |
| 7,091,986 | B2 * | 8/2006 | Phan | 345/589 |
| 7,145,580 | B2 | 12/2006 | Kim et al. | |
| 7,154,509 | B2 * | 12/2006 | Nair et al. | 345/601 |
| 7,268,792 | B2 | 9/2007 | Lee et al. | |
| 7,636,076 | B2 * | 12/2009 | Hung et al. | 345/88 |
| 8,072,473 | B2 | 12/2011 | Kim et al. | |
| 2001/0013850 | A1 * | 8/2001 | Sakaguchi et al. | 345/87 |
| 2003/0210216 | A1 | 11/2003 | Kim et al. | |
| 2004/0114046 | A1 | 6/2004 | Lee et al. | |
| 2004/0223058 | A1 | 11/2004 | Richter et al. | |
| 2004/0246268 | A1 | 12/2004 | Nair et al. | |
| 2005/0068287 | A1 | 3/2005 | Lin et al. | |
| 2005/0212786 | A1 | 9/2005 | Nitta et al. | |
| 2007/0013628 | A1 * | 1/2007 | Kim et al. | 345/89 |
| 2007/0024557 | A1 * | 2/2007 | Rho et al. | 345/88 |

* cited by examiner

*Primary Examiner* — Quan-Zhen Wang
*Assistant Examiner* — Jennifer Nguyen
(74) *Attorney, Agent, or Firm* — Birch, Stewart, Kolasch & Birch, LLP

(57) ABSTRACT

A multi-resolution display system having a system module, a plurality of resolution control modules and a display module. Each resolution control module is used for receiving an input data in a first color space and outputting a resolution data in a second color space. The display module includes a plurality of areas. Each area receives the resolution data from one of the resolution control modules. The display module can show various resolution data in various areas on the same screen at the same time.

36 Claims, 9 Drawing Sheets

MULTI-RESOLUTION DISPLAY SYSTEM

BACKGROUND OF THE INVENTION

1. Field of the Invention

The present invention relates to a display system, and in particular, to a multi-resolution display system.

2. Description of the Related Art

Conventional display such as Liquid Crystal Display (LCD), Organic Light Emitting Diode (OLED), Electronic Paper Display (EPD) display has only one native physical resolution, which is determined by the number of full color RGB pixels physically built into the display. A display with a native resolution of 640×RGB×480 means that there are 640×480=307,200 full color RGB pixels. If the input signal to this display has a resolution differing from the native resolution 640×RGB×480 of the said display, a scaler needs to rescale the input signal to match exactly the given native resolution of the said display.

Nowadays, consumers tend to opt for an universal display device, specially a mobile device, which could fulfil different applications such as electronic book (eBook), Ultra Mobile Personal Computer (UMPC), Portable Media Player (PMP), Geographic Positioning System (GPS) . . . with power efficiency function and indoor/outdoor readability. Since power saving is very critical for a mobile device, especially for a LCD display, such an universal mobile device tends to be transmissive (backlight illuminates the display) and reflective (ambient light reflection illuminates the display), and the general terminology is a transflective display. On the other hand, by using a multi-primary pixel display such as a quad-pixel of Red, Green, Blue and White (RGBW), the brightness increases considerably because the white color dot is usually a transparent coating on the color filter of a LCD display and it lets white backlight goes through stronger than through other primary colors R, G and B. For LCD reflective display mode and Electronic Paper Display, where usually there is only one reflective mode, the benefit to add a white dot on a RGB pixel is also important because the white color reflects more light than R, G and B.

US Patent Publication No. 2005/0068287 discloses a multi-resolution driver device. Depending on the input image data resolutions, which are lower or equal to the native physical resolution of a given display, the physical pixels may be driven individually in sequence, or two or more physical pixels may be grouped as a logical pixel (i.e., driven simultaneously with same data) and adjacent logical pixels are driven in sequence using shift registers and switches in the driver device. The motive of this driven method is mainly to lower the transmission data rate of the system device to the display device with lower input image data resolution, thus achieving the power saving on the system side for a certain application mode. The downside of this method is that it uses a high-resolution display as the base to accommodate lower input image data resolution by grouping and driving two or more physical pixels simultaneously, thus lower the display performance while maintaining the high power and high cost of the high resolution display.

Usually for such a display system, the usage ratio of the low input image data resolution mode, such as text and menu mode in a mobile device, is much higher than the usage of the native high-resolution display mode, such as image/video mode, then the adoption of a high-resolution, backlight power hungry and high cost mobile display module does not justify the power saving in the system module side.

On the other side, this multi-resolution display system requires that the operating system (OS) in the system module supports the dynamic resolution mode to change different image data resolutions on the fly but nowadays system OS such as Window Mobile from Microsoft does not support dynamic resolution mode.

Therefore, it is necessary to provide a multi-resolution display system to solve the above-mentioned problems.

SUMMARY OF THE INVENTION

In contrast to multi-resolution driver device according to US Patent Application 2005/0068287, the multi-resolution display system of the invention provides a cost effective and much lower power saving solution for a multi purpose display system.

A mobile display system of the invention, such as a transflective LCD display system, can be used as eBook with grey level high resolution for text for outdoor use in reflective mode without backlight turned on to save power in one occasion or as color text with low resolution picture in transflective mode with backlight turned on in a second occasion or as high resolution color animation/video screen also in transflective mode with backlight turned on in a third occasion, or as a combination of these three display modes in separate overlaid display windows on the same screen in a fourth occasion. The multi-resolution display system of the invention responds to different application requirements, even on the same screen at the same time, with the most power saving in backlight and system power without compromising display performance significantly.

One objective of the invention is to provide a multi-resolution display system. The multi-resolution display system of the invention comprises a plurality of resolution control modules, at least one selection signal and a display module. Each resolution control module is used for receiving an input data in a first color space and outputting a resolution data in a second color space. The selection signal is used for selecting a selected resolution control module from the resolution control modules. The display module is used for receiving the resolution data of the selected resolution control module and showing a corresponding image.

Another objective of the invention is to provide a multi-resolution display system. The multi-resolution display system of the invention comprises a plurality of resolution control modules and a display module. Each resolution control module is used for receiving an input data in a first color space and outputting a resolution data in a second color space. The display module comprises a plurality of areas. Each area receives the resolution data from one of the resolution control modules. The display module is used for showing a corresponding image.

DETAILED DESCRIPTION OF THE INVENTION

Figure 1:
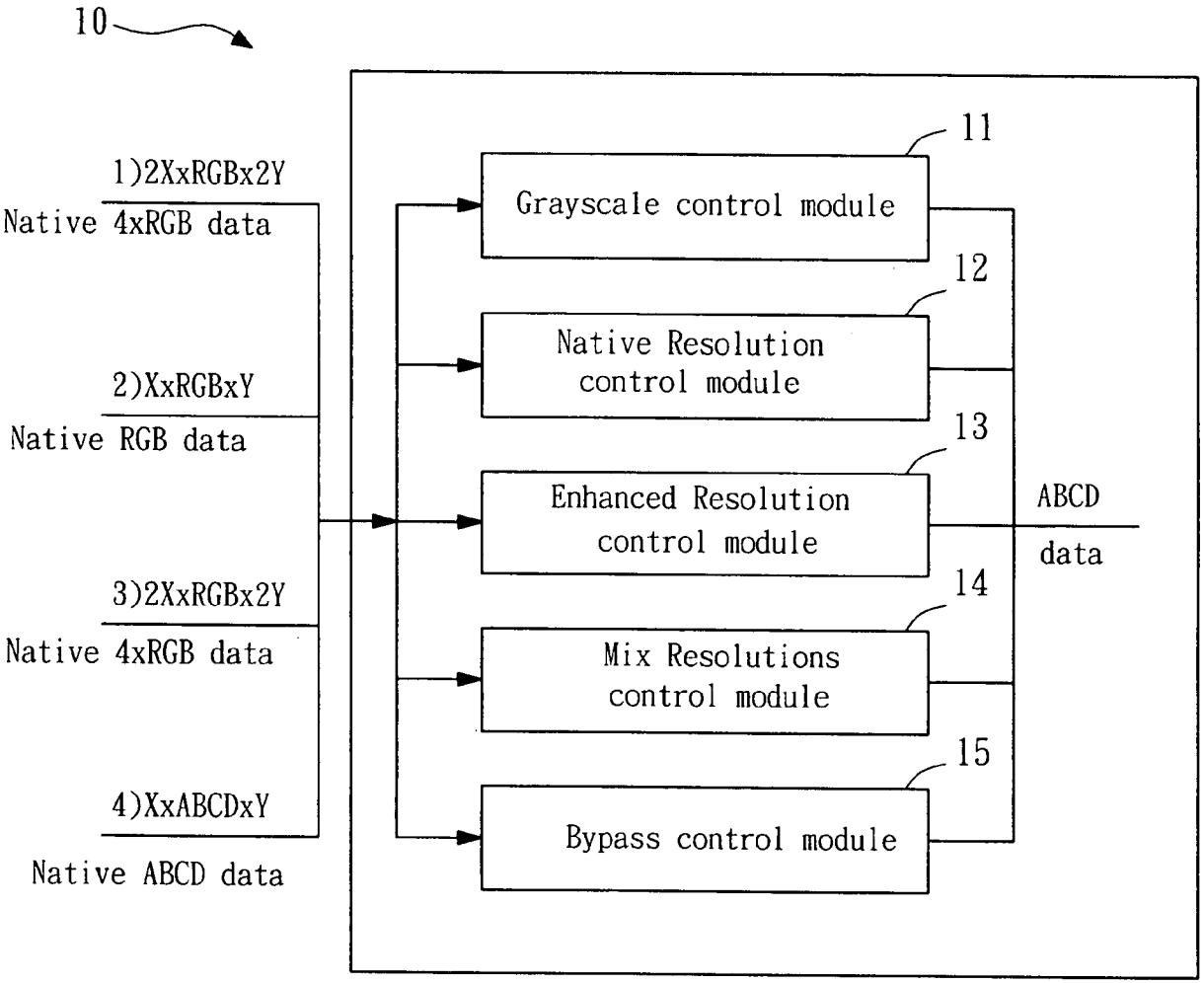
FIG. 1 shows a multi-resolution engine according to the invention.

Referring to FIG. 1, it shows a multi-resolution engine according to the invention. The multi-resolution engine 10 comprises a plurality of resolution control modules 11, 12, 13, 14, and 15. Each resolution control module is used for receiving an input data in a first color space and outputting a resolution data in a second color space. For example, the first color space is the conventional RGB strip color space, and the second color space is four dots color space, for example ABCD four dots, for example the "A" is a red "R" primary color dot, the "B" is a green "G" primary color dot, the "C" is a blue "B" primary color dot, the "D" is a white "W" primary color dot.

The multi-resolution engine 10 comprises a first resolution control module 11, a second resolution control module 12, a third resolution control module 13, a fourth resolution control module 14 and a fifth resolution control module 15. The first resolution control module 11 is used for receiving a first input data and outputting the resolution data. The first resolution control module 11 is a grayscale control module. The first input data is 2X×RGB×2Y, wherein RGB is RGB signal data, the X is the number of the pixel group in a horizontal axis, the Y is the number of the pixel group in a vertical axis. The resolution data is X×ABCD×Y, wherein ABCD is four dot data. The resolution data further comprises a first backlight control signal for controlling a backlight unit in a display module, for example turning off the backlight unit. In the grayscale control module, a transflective technology can be used to control the backlight.

The second resolution control module 12 is used for receiving a second input data and outputting the resolution data. The second resolution control module 12 is a native resolution control module. The second input data is X×RGB×Y, the resolution data further comprises a second backlight control signal for turning on the backlight unit in the display module.

The third resolution control module 13 is used for receiving a third input data and outputting the resolution data. The third resolution control module 13 is an enhanced resolution control module. The third input data is 2X×RGB×2Y, the resolution data further comprises a third backlight control signal for turning on a backlight unit in the display module. The third resolution control module 13 can utilizes the method mentioned in U.S. Pat. Nos. 6,661,429, 7,091,986 and 20050151752.

The fourth resolution control module 14 is used for receiving the first input data, the second input data or the third data and outputting the resolution data. The fourth resolution control module 14 is a mix resolution control module. The resolution data further comprises an area control signal for determining a plurality of areas in the display module, and each area receives the resolution data from one of the first resolution control module 11, the second resolution control module 12 and the third resolution control module 13.

The fifth resolution control module 15 is used for receiving a fifth input data and outputting the resolution data. The fifth resolution control module 15 is a bypass control module, and the resolution data is the same as the fifth input data. In the embodiment, the fifth input data is X×ABCD×Y. The selection signal comprises a second pin signal for selecting the fifth resolution control module 15.

Figure 2A:
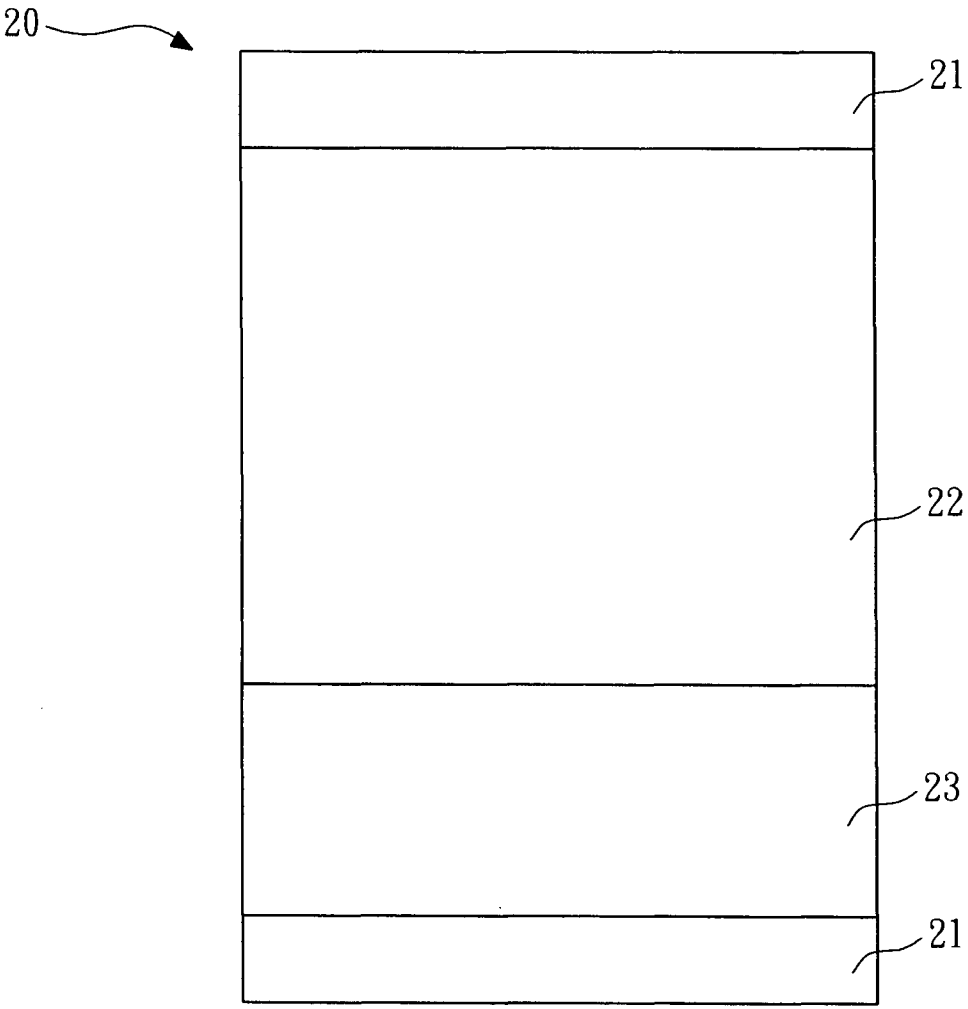
FIG. 2A shows a display module with areas corresponding to various resolution data, according to the invention.

Referring to FIG. 2A, it shows a display module 20 with areas corresponding to various resolution data, according to the invention. The display module 20 comprises a first area 21, a second area 22 and a third area 23. For example, the first area 21 receives the resolution data from the third resolution control module 13, the second area 22 receives the resolution data from the second resolution control module 12, and the third area 23 receives the resolution data from the first resolution control module 11. Each area is a rectangular area, and the first area 21 is displaced on the upper and lower edge of the display module 20. Besides, the backlight unit of the display module 20 can be switched on or off according to the various area and the backlight control signals from the various resolution control modules.

Figure 2B:
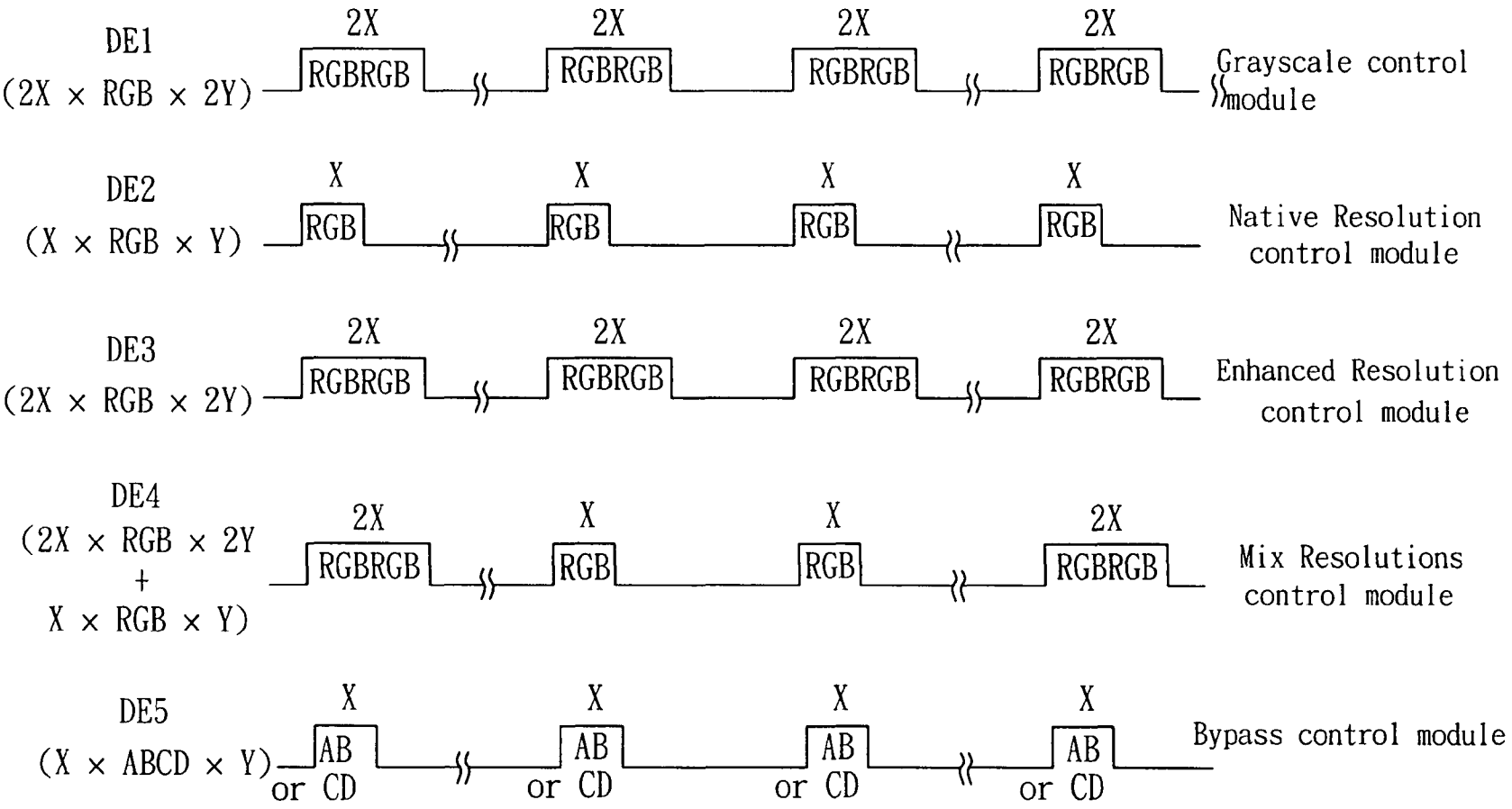
FIG. 2B shows data enable signals for selecting the resolution control modules, according to the invention.

Referring to FIG. 2B, it shows selection signals for selecting the resolution control modules, according to the invention. In the embodiment, the selection signal comprises a data enable signal (DE). A duty cycle of the data enable signal is used for recognizing the first input data, the second input data and the third input data. A first data enable signal (DE1) is used for the grayscale resolution control module, a second data enable signal (DE2) is used for the native resolution control module, a third data enable signal (DE3) is used for the enhanced resolution control module, a fourth data enable signal (DE4) is used for the mix resolution control module, and a fifth data enable signal (DE5) is used for the bypass resolution control module. In the embodiment, the first data enable signal (DE1) and the third data enable signal (DE3) have a first duty cycle for the first input data and the third input data, for example 2X×RGB×2Y, and the second data enable signal (DE2) has a second duty cycle used for the second input data, for example X×RGB×Y. In the mix resolution control module, the fourth data enable signal (DE4) has a third duty cycle used for the mix input data having the first input data, the second input data and the third input data.

Figure 2C:
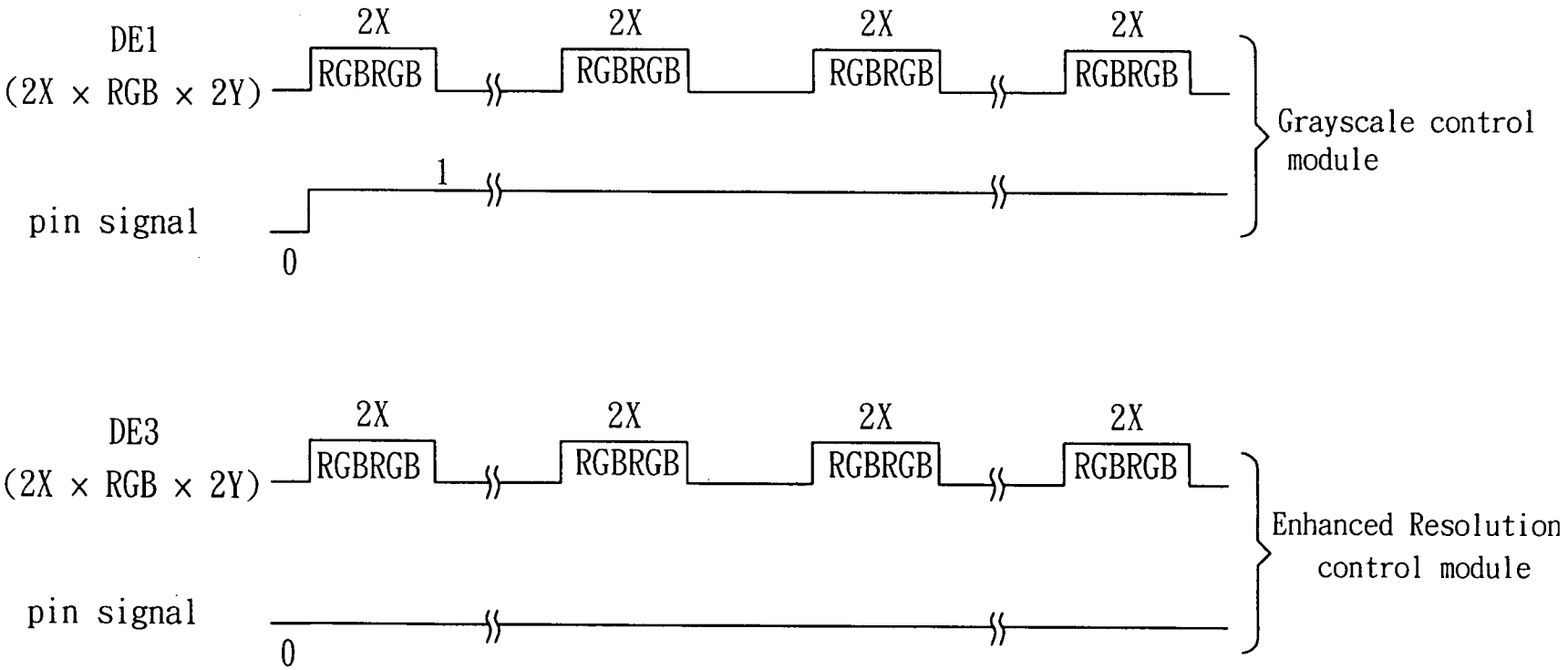
FIG. 2C shows data enable signals and pin signal for selecting the first and the third resolution control modules, according to the invention.

However, the first input data is the same as the third input data, the selection signal further comprises at least one pin signal for recognizing the first input data for the first resolution control module 11 and the third input data for the third resolution control module 13. Referring to FIG. 2C, in the embodiment, a low level of the pin signal is used for selecting the third resolution control module 13, that is, the backlight unit turns on. A high level of the pin signal is used for selecting the first resolution control module 11, that is, the backlight unit turns off.

Figure 2D:
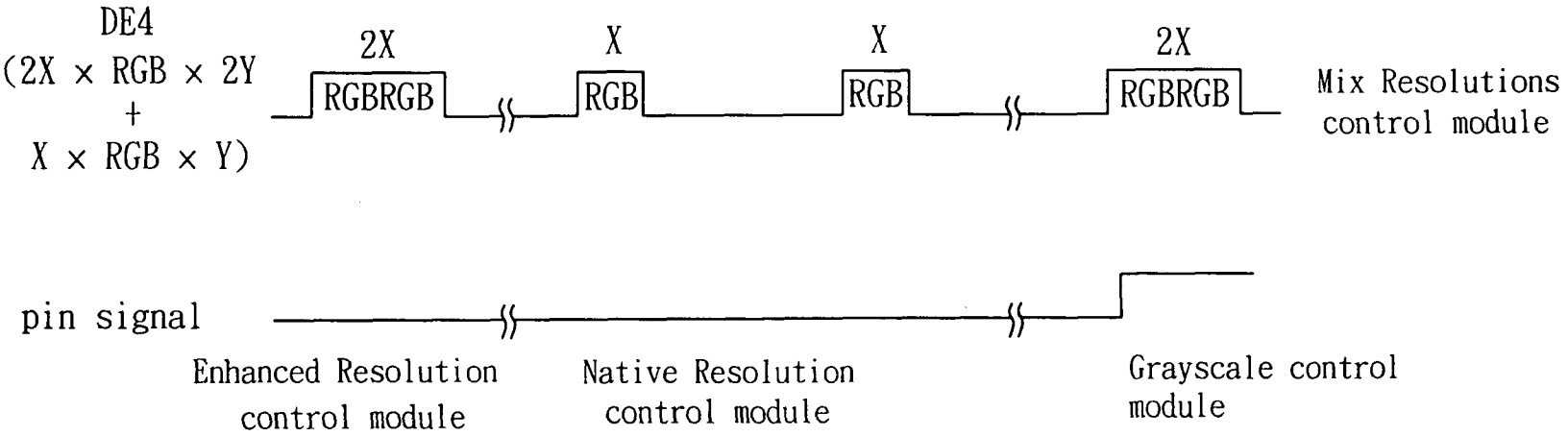
FIG. 2D shows data enable signal and pin signal for the fourth resolution control module, according to the invention.

Referring to FIG. 2D, in the mix resolution control module, the data enable signal (DE4) has a third duty cycle used for the mix input data having the first input data, the second input data and the third input data. However, the first input data is the same as the third input data, the selection signal further comprises at least one pin signal for recognizing the first input data for the first resolution control module 11 and the third input data for the third resolution control module 13. A low level of the pin signal is used for selecting the third resolution control module 13, that is, the backlight unit turns on. A high level of the pin signal is used for selecting the first resolution control module 11, that is, the backlight unit turns off.

By utilizing the selection signals and the resolution control modules, the display module 20 can show various resolution data in various areas on the same screen at the same time, with the most power saving in backlight and system power without compromising too much display performances.

Figure 3:
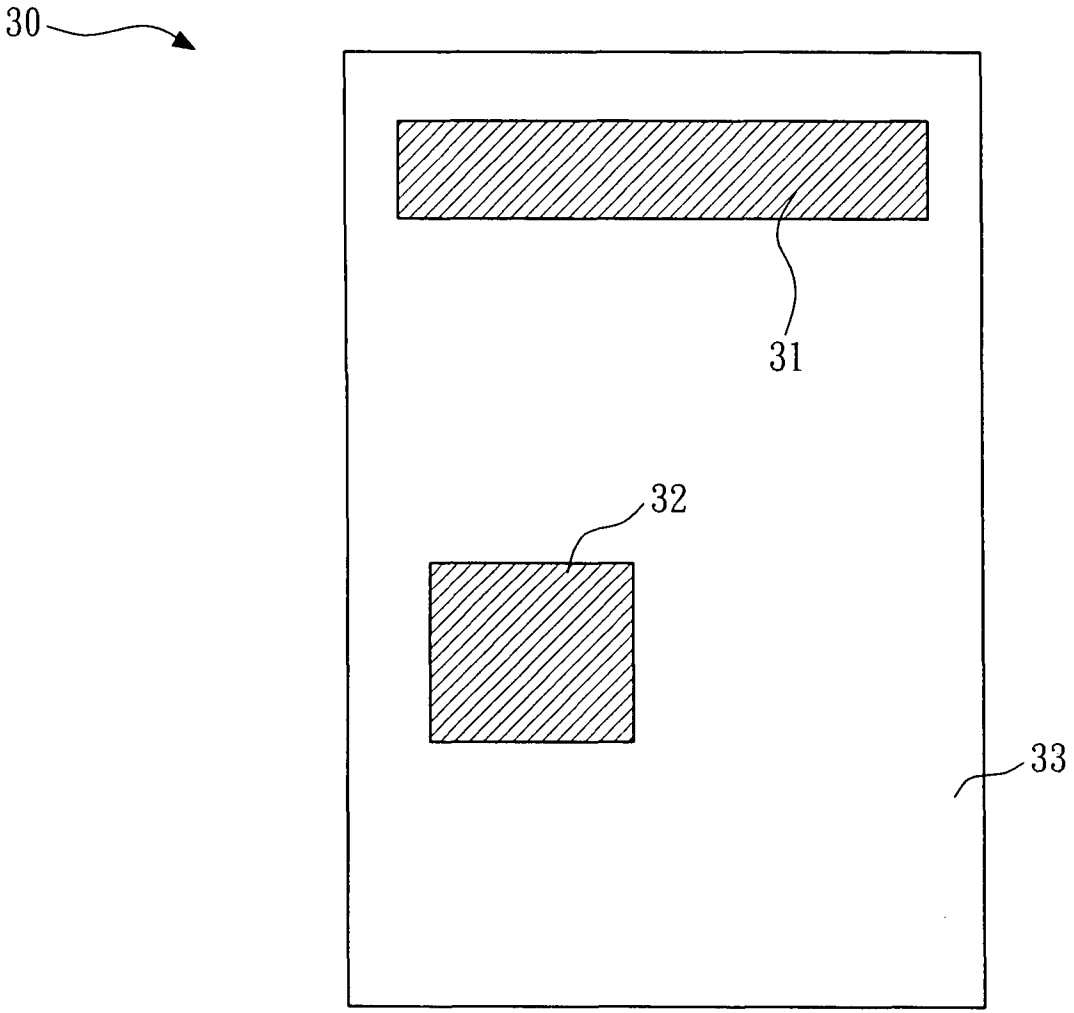
FIG. 3 shows another display module with areas corresponding to various resolution data, according to the invention.

Referring to FIG. 3, it shows another display module 30 with areas corresponding to various resolution data, according to the invention. The display module 30 comprises a first area 31, a second area 32 and a third area 33. For example, the first area 31 receives the resolution data from the third resolution control module 13, the second area 32 receives the resolution data from the second resolution control module 12, and the third area 33 receives the resolution data from the first resolution control module 11. The first area 31 and the second area 32 are rectangular areas, and the other area of the display module 30 is the third area 33. For example, the first area 31 can be an image for showing a logo of a company, the second area 32 can show a picture or a photograph, and the third area 33 can show text. Besides, the backlight unit of the display module 30 can be switched on or off according to the various area and the backlight control signals from the various resolution control modules.

Figure 4:
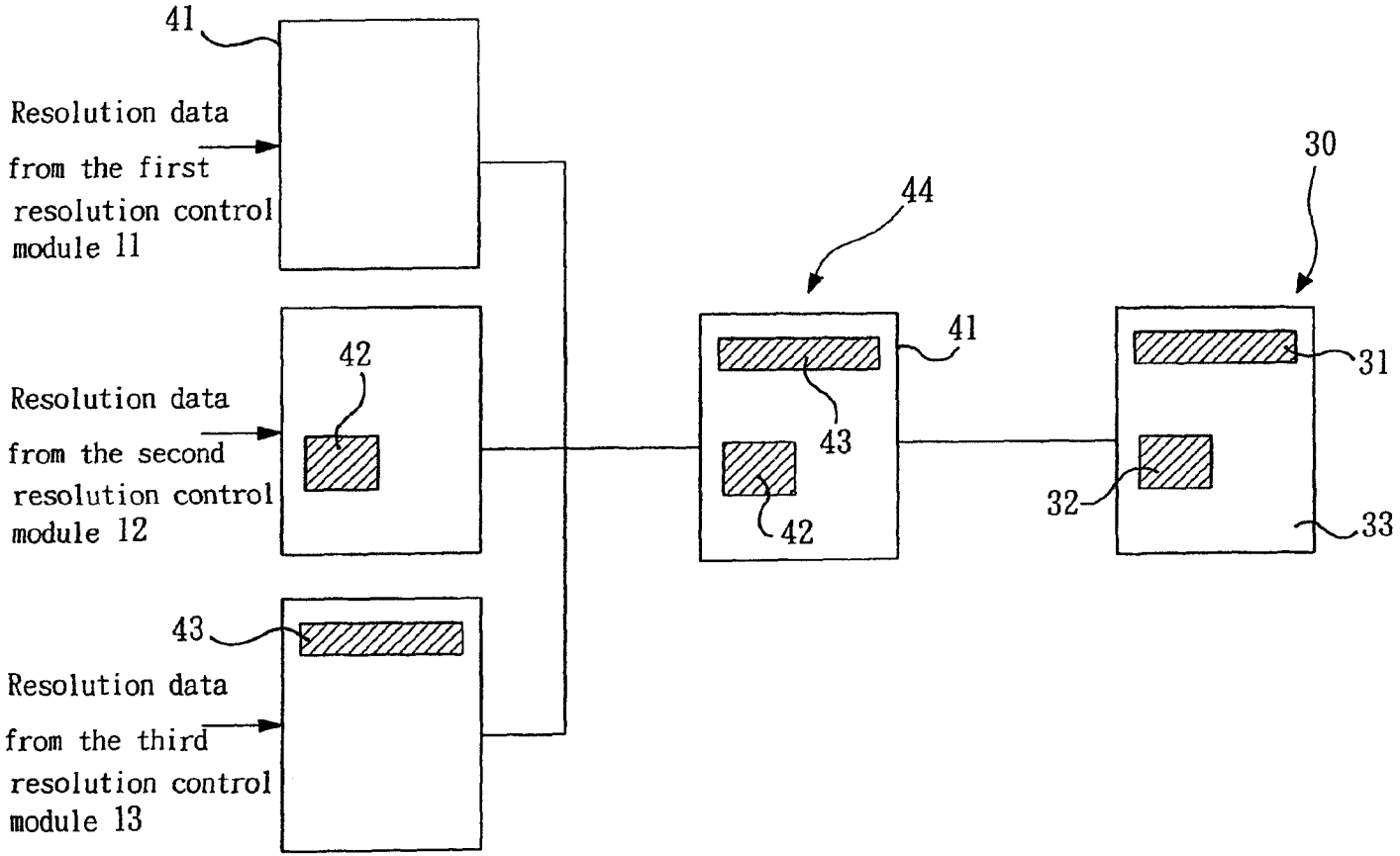
FIG. 4 shows a process for showing various resolution data in the corresponding areas of the display module, according to the invention.

Referring to FIG. 4, it shows a process for showing various resolution data in the corresponding areas of the display module 30, according to the invention. The resolution data from the first resolution control module is stored in a first frame buffer 41, the resolution data from the second resolution control module is stored in a second frame buffer 42, the resolution data from the third resolution control module is stored in a third frame buffer 43, the resolution data in the first frame buffer 41, the second frame buffer 42 or/and the third frame buffer 43 are integrated in a display frame buffer 44, the resolution data of the display frame buffer 44 are transmitted to the display module 30.

Figure 5:
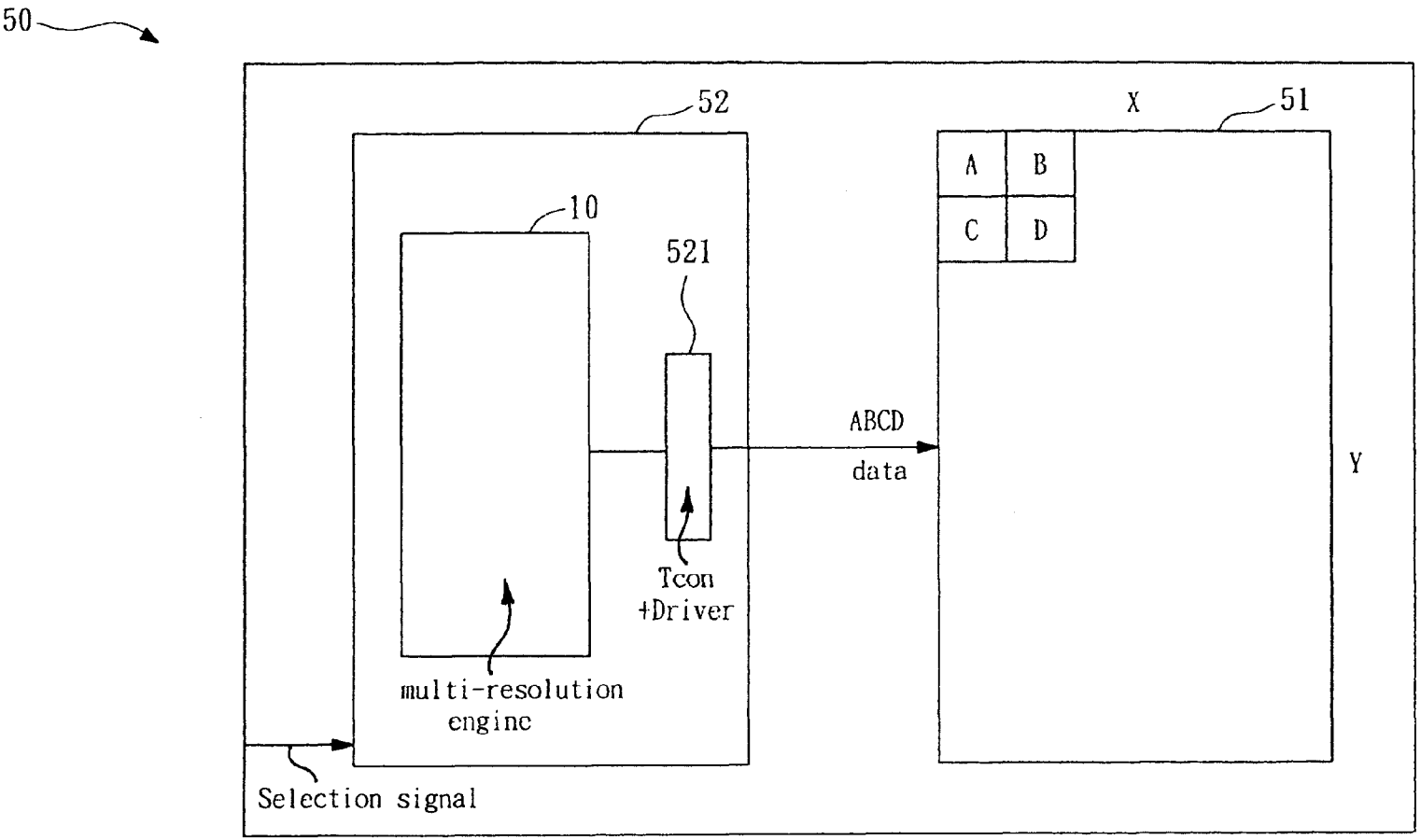
FIG. 5 shows a multi-resolution display system according to a first embodiment of the invention.

Referring to FIG. 5, it shows a multi-resolution display system according to the first embodiment of the invention. The multi-resolution display system 50 is a display module, and comprises a multi-resolution engine 10, at least one selection signal and a display panel 51. The multi-resolution engine 10 comprises a plurality of resolution control modules 11, 12, 13, 14, and 15 as shown in FIG. 1. The selection signal is used for selecting a selected resolution control module from the resolution control modules 11, 12, 13, 14, and 15. The display panel 51 is used for receiving the resolution data of the selected resolution control module and showing a corresponding image.

In the first embodiment, the multi-resolution engine 10 is incorporated in the display module 50. Besides, the multi-resolution display system 50 further comprises a display driver device 52. The multi-resolution engine 10 is incorporated in the display driver device 52 of the display module 50. The display driver device 52 further comprises a Tcon and driver 521 for outputting clock signal and driving signal. The display panel 51 comprises a plurality of pixel groups. Each pixel group comprises four dots arranged in a predetermined matrix form. The resolution data comprises a plurality of pixel group data, each pixel group data comprises four dot data. The resolution data is X×ABCD×Y, wherein X is the number of the pixel group in a horizontal axis, Y is the number of the pixel group in a vertical axis, ABCD is four dot data, for example the "A" is a red "R" primary color dot, the "B" is a green "G" primary color dot, the "C" is a blue "B" primary color dot, the "D" is a white "W" primary color dot.

As described in the above, the selection signal comprises at least one pin signal for selecting the selected resolution control module in the multi-resolution engine 10. Furthermore, the selection signal comprises a data enable signal (DE) for selecting the selected resolution control module in the multi-resolution engine 10. The selection signal may further comprises a header command for selecting the selected resolution control module in the multi-resolution engine 10.

Figure 6:
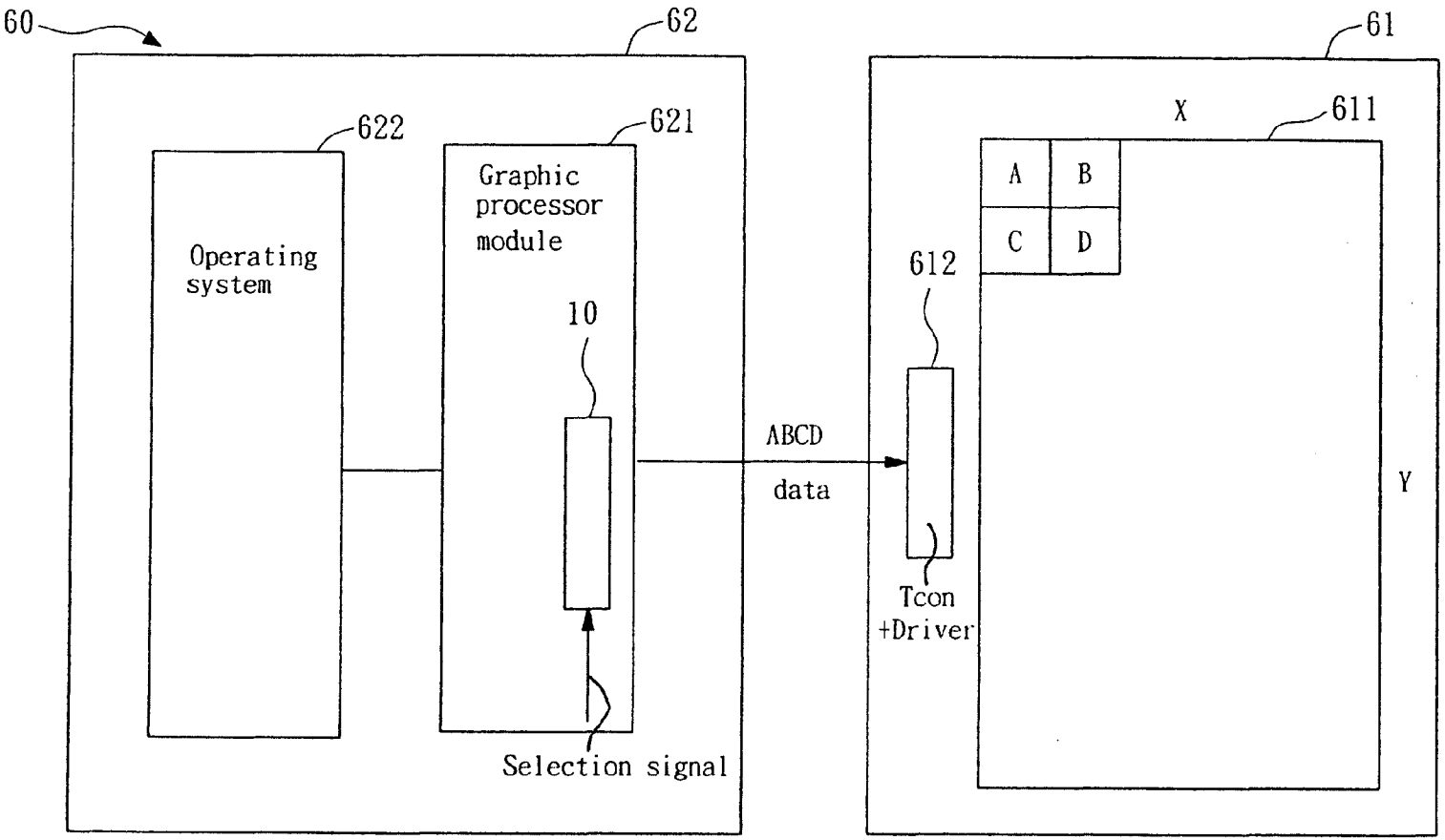
FIG. 6 shows a multi-resolution display system according to a second embodiment of the invention.

Referring to FIG. 6, it shows a multi-resolution display system according to a second embodiment of the invention. The multi-resolution display system 60 comprises a multi-resolution engine 10, at least one selection signal and a display panel 61. The multi-resolution engine 10 comprises a plurality of resolution control modules 11, 12, 13, 14, and 15 as shown in FIG. 1. The selection signal is used for selecting a selected resolution control module from the resolution control modules 11, 12, 13, 14, and 15. The display panel 61 is used for receiving the resolution data of the selected resolution control module and showing a corresponding image.

In the second embodiment, the multi-resolution engine 10 is incorporated in a system module 62. The system module 62 comprises a graphic processor module 621, and the multi-resolution engine 10 is incorporated in the graphic processor module 621. The system module 62 further comprises an operating system 622 for support the resolution control modules.

The display module 61 comprises a display panel 611 and a display driver device 612. The display driver device 612 comprises a Tcon and driver for outputting clock signal and driving signal. The display panel 611 is the same as the display panel 51 in the first embodiment, and will not be described in detail.

According to the invention, the multi-resolution display system provides a cost effective and much lower power saving solution for a multi purpose display system. A mobile display system of the invention, such as a transflective LCD display system, can be used as eBook with grey level high resolution for text for outdoor use in reflective mode without backlight turned on to save power in one occasion or as color text with low resolution picture in transflective mode with backlight turned on in a second occasion, or as high resolution color animation/video screen, or in transflective mode with backlight turned on in a third occasion, or as a combination of these three display modes in separate overlaid display windows on the same screen in a fourth occasion. The multi-resolution display system of the invention responds to different application requirements, even on the same screen at the same time, with the most power saving in backlight and system power without significantly compromising display performance.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A multi-resolution display system, comprising:

at least four resolution control modules, each of the resolution control modules for receiving an input data in a first color space and outputting a resolution data in a second color space;

one or more selection signals, for respectively selecting one or more of the at least four resolution control modules; and a display module, for receiving the resolution data of the one or more of the at least four resolution control modules and showing a corresponding image, wherein the display module comprises a plurality of pixel groups, each of the pixel groups comprises four dots arranged in a predetermined matrix form, and the resolution data comprises a plurality of pixel group data, data in each of the pixel groups comprises four dot data, the resolution data is X×ABCD×Y in the second color space, wherein X is the number of the pixel group in a horizontal axis, Y is the number of the pixel group in a vertical axis, and ABCD is the four dot data, and wherein one of resolution control modules is a mix resolution control module for receiving at least a first input data in a first selection signal, and a second input data in a second selection signal.

2. The multi-resolution display according to claim 1, wherein each pixel group comprises only four dots arranged in a predetermined matrix form.

3. The multi-resolution display system according to claim 2, wherein the first resolution control module is a grayscale control module for receiving a the first input data and outputting the resolution data, the first input data is 2X×RGB×2Y in the first color space, wherein RGB is RGB signal data, and the resolution data further comprises a first backlight control signal for controlling a backlight unit in the display module.

4. The multi-resolution display system according to claim 3, wherein the second resolution control module is a native resolution control module for receiving second the second input data and outputting the resolution data, the second input data is X×RGB×Y in the first color space, and the resolution data further comprises a second backlight control signal for controlling the backlight unit in the display module.

5. The multi-resolution display system according to claim 4, wherein the third resolution control module is an enhanced resolution control module for receiving a third input data and outputting the resolution data, the third input data is 2X×RGB×2Y in the first color space, and the resolution data further comprises a third backlight control signal for controlling the backlight unit in the display module.

6. The multi-resolution display system according to claim 5, wherein the mix resolution control module is a fourth resolution control module for receiving the first input data, the second input data or/and the third data and outputting the resolution data, the resolution data further comprises an area control signal for determining a plurality of areas in the display module, and each area receives the resolution data from one of the first resolution control module, the second resolution control module and the third resolution control module.

7. The multi-resolution display system according to claim 6, wherein the selection signal comprises a data enable signal.

8. The multi-resolution display system according to claim 7, wherein a duty cycle of the data enable signal is used for recognizing the first input data, the second input data and the third input data, a first duty cycle of the data enable signal for the first input data and the third input data, a second duty cycle of the data enable signal for the second input data.

9. The multi-resolution display system according to claim 8, wherein the selection signal further comprises at least one pin signal having a low level and a high level for selecting the first resolution control module and the third resolution control module.

10. The multi-resolution display system according to claim 6, wherein the resolution data from the first resolution control module is stored in a first frame buffer, the resolution data from the second resolution control module is stored in a second frame buffer, the resolution data from the third resolution control module is stored in a third frame buffer, the resolution data in the first frame buffer, the second frame buffer or/and the third frame buffer are integrated in a display frame buffer, the resolution data of the display frame buffer are transmitted to the display module.

11. The multi-resolution display system according to claim 6, wherein the fifth resolution control module is a bypass control module for receiving a fifth input data and outputting the resolution data, and the resolution data is the same as the fifth input data.

12. The multi-resolution display system according to claim 11, wherein the selection signal further comprises a second pin signal for selecting the fifth resolution control module.

13. The multi-resolution display system according to claim 1, wherein the selection signal comprises a header command.

14. The multi-resolution display system according to claim 1, wherein the resolution control modules are incorporated in the display module.

15. The multi-resolution display system according to claim 14, wherein the resolution control modules are incorporated in a display driver device of the display module.

16. The multi-resolution display system according to claim 1, wherein the resolution control modules are incorporated in a system module.

17. The multi-resolution display system according to claim 16, wherein the resolution control modules are incorporated in a graphic processor module of the system module.

18. The multi-resolution display system according to claim 16, wherein the system module further comprises an operating system for supporting the resolution control modules.

19. The multi-resolution display system according to claim 1, wherein the display module shows the corresponding image on one frame.

20. A multi-resolution display system, comprising:

at least four resolution control modules, each of the resolution control modules for receiving an input data in a first color space and outputting a resolution data in a second color space; and a display module, comprising a plurality of areas, each area receiving the resolution data from one of the at least four resolution control modules, and showing a corresponding image, wherein the display module comprises a plurality of pixel groups, each of the pixel groups comprises four dots arranged in a predetermined matrix form, and the resolution data comprises a plurality of pixel group data, data in each of the pixel groups comprises four dot data, and the resolution data is X×ABCD×Y in the second color space, wherein X is the number of the pixel group in a horizontal axis, Y is the number of the pixel group in a vertical axis, and ABCD the is the four dot data, wherein one of resolution control modules is a mix resolution control module for receiving at least a first input data in a first selection signal, and a second input data in a second selection signal.

21. The multi-resolution display according to claim 20, wherein each pixel group comprises only four dots arranged in a predetermined matrix form.

22. The multi-resolution display system according to claim 21, wherein the first resolution control module is a grayscale control module for receiving the first input data and outputting the resolution data, the first input data is 2X×RGB×2Y in the first color space, wherein RGB is RGB signal data, and the resolution data further comprises a first backlight control signal for controlling a backlight unit in the display module.

23. The multi-resolution display system according to claim 22, wherein the second resolution control module is a native resolution control module for receiving the second input data and outputting the resolution data, the second input data is X×RGB×Y in the first color space, and the resolution data further comprises a second backlight control signal for controlling the backlight unit in the display module.

24. The multi-resolution display system according to claim 23, wherein the third resolution control module is an enhanced resolution control module for receiving a third input data and outputting the resolution data, the third input data is 2X×RGB×2Y in the first color space, and the resolution data further comprises a third backlight control signal for controlling the backlight unit in the display module.

25. The multi-resolution display system according to claim 24, wherein the mix resolution control module is a fourth resolution control module for receiving the first input data, the second input data or the third data and outputting the resolution data, the resolution data further comprises an area control signal for determining the areas in the display module, and each area receives the resolution data from one of the first resolution control module, the second resolution control module and the third resolution control module.

26. The multi-resolution display system according to claim 25, further comprising at least one selection signal for selecting one of the first resolution control module, the second resolution control module and the third resolution control module in each area.

27. The multi-resolution display system according to claim 26, wherein the selection signal comprises a data enable signal, a duty cycle of the data enable signal is used for recognizing the first input data, the second input data and the third input data, a first duty cycle of the data enable signal for the first input data and the third input data, a second duty cycle of the data enable signal for the second input data.

28. The multi-resolution display system according to claim 26, wherein the selection signal further comprises at least one pin signal having a low level and a high level for selecting the first resolution control module and the third resolution control module.

29. The multi-resolution display system according to claim 26, wherein the selection signal comprises a header command.

30. The multi-resolution display system according to claim 25, wherein the resolution data from the first resolution control module is stored in a first frame buffer, the resolution data from the second resolution control module is stored in a second frame buffer, the resolution data from the third resolution control module is stored in a third frame buffer, the resolution data in the first frame buffer, the second frame buffer or/and the third frame buffer are integrated in a display frame buffer, the resolution data of the display frame buffer are transmitted to the display module.

31. The multi-resolution display system according to claim 20, wherein the resolution control modules are incorporated in the display module.

32. The multi-resolution display system according to claim 31, wherein the resolution control modules are incorporated in a display driver device of the display module.

33. The multi-resolution display system according to claim 20, wherein the resolution control modules are incorporated in a system module.

34. The multi-resolution display system according to claim 33, wherein the resolution control modules are incorporated in a graphic processor module of the system module.

35. The multi-resolution display system according to claim 34, wherein the system module further comprises an operating system for supporting the resolution control modules.

36. The multi-resolution display system according to claim 20, wherein the display module shows the corresponding image on one frame.

* * * * *